US009197952B2

(12) United States Patent
Fleischman et al.

(10) Patent No.: US 9,197,952 B2
(45) Date of Patent: Nov. 24, 2015

(54) PROTECTIVE SPEAKER COVER

(71) Applicants: Todd Fleischman, Boca Raton, FL (US); Joe DiMauro, Boca Raton, FL (US)

(72) Inventors: Todd Fleischman, Boca Raton, FL (US); Joe DiMauro, Boca Raton, FL (US)

( * ) Notice: Subject to any disclaimer, the term of this patent is extended or adjusted under 35 U.S.C. 154(b) by 166 days.

(21) Appl. No.: 14/132,952

(22) Filed: Dec. 18, 2013

(65) Prior Publication Data

US 2014/0169606 A1 Jun. 19, 2014

Related U.S. Application Data

(60) Provisional application No. 61/739,014, filed on Dec. 19, 2012.

(51) Int. Cl.
*H04R 25/00* (2006.01)
*H04R 1/02* (2006.01)

(52) U.S. Cl.
CPC ..... *H04R 1/023* (2013.01)

(58) Field of Classification Search
CPC ..... H04R 2499/11; H04R 5/02
USPC ..... 381/334
See application file for complete search history.

(56) References Cited

U.S. PATENT DOCUMENTS

| | | | | |
|---|---|---|---|---|
| 3,987,258 | A * | 10/1976 | Tsutsui et al. | 381/334 |
| 6,658,132 | B1 * | 12/2003 | Moster et al. | 381/388 |
| 2005/0053253 | A1 * | 3/2005 | Sterns | 381/345 |
| 2006/0177089 | A1 * | 8/2006 | Greco et al. | 381/391 |
| 2012/0321121 | A1 * | 12/2012 | Taylor et al. | 381/391 |

* cited by examiner

*Primary Examiner* — Simon King
(74) *Attorney, Agent, or Firm* — Robert M. Downey, P.A.

(57) ABSTRACT

A protective speaker cover includes a main body and a securing mechanism for releasably securing the protective cover to an audio speaker grille. The main body includes a faceplate having sidewalls extending from an outer perimeter edge of the faceplate and being sized to cover the speaker grille surrounding the audio speaker. In one embodiment, the securing mechanism is a plurality of aligned clips extending from the inner facing side of the faceplate and having protrusions at a distal end being sized for snap-lock engagement within the open grooves of the speaker grille. In another embodiment, the inner facing surface of the sidewalls includes at least one spring-loaded member for securing the main body against the outer facing wall of the speaker grille. In another embodiment of the securing mechanism, the inner facing surface of the sidewalls includes a rubberized gasket for frictionally engaged receipt of the speaker grille.

13 Claims, 3 Drawing Sheets

PROTECTIVE SPEAKER COVER

This application is based on provisional patent application Ser. No. 61/739,014 filed on Dec. 19, 2012.

BACKGROUND OF THE INVENTION

1. Field of the Invention

The present invention relates to audio speaker covers and, more particularly, a protective speaker cover securable to an audio speaker grille.

2. Discussion of the Related Art

Audio speakers are often installed for outdoor use, such as around a pool patio or backyard deck. Moreover, boats and other marine vessels are often equipped with onboard audio speakers for enjoying music while out on the water. However, outdoor audio speakers are prone to undergo corrosion due to exposure to salt water, rain, direct sunlight and other elements of an outdoor environment. Replacement of damaged onboard audio speakers can be a costly undertaking and there are no protective covers specifically adapted for protecting audio speaker components from exposure to corrosive elements.

In light of the shortcomings associated with the prior art, there remains a need for a protective speaker cover including a faceplate main body and a securing mechanism for releasably securing the protective cover to the audio speaker grille.

OBJECTS AND ADVANTAGES OF THE INVENTION

Considering the foregoing, it is a primary object of the present invention to provide a protective speaker cover for limiting exposure of an audio speaker from corrosive elements.

It is a further object of the present invention to provide a protective speaker cover that is releasably securable to an audio speaker.

These and other objects and advantages of the present invention are more readily apparent with reference to the detailed description and accompanying drawings.

SUMMARY OF THE INVENTION

The present invention is directed to a protective speaker cover including a main body and a securing mechanism for releasably securing the protective cover to an audio speaker grille. The main body includes a faceplate having sidewalls extending from an outer perimeter edge of the faceplate and being sized to cover the speaker grille surrounding the audio speaker. In one embodiment, the securing mechanism is a plurality of aligned clips extending from the inner facing side of the faceplate and having protrusions at a distal end being sized for snap-lock engagement within the open grooves of the audio speaker grille. Another embodiment of the securing mechanism includes a plurality of aligned, oppositely disposed clips extending from the inner facing side of the faceplate and having protrusions sized for snap-lock engagement within the open grooves of the audio speaker grille. In another embodiment, the inner facing surface of the sidewalls includes at least one spring-loaded member for securing the main body against the outer facing wall of the audio speaker grille. The inner facing surface of the sidewalls may further include biasing members for providing additional force between the outer facing wall of the audio speaker grille and the inner facing surface of the main body sidewalls. In another embodiment of the securing mechanism, the inner facing surface of the sidewalls includes a rubberized gasket for frictionally engaged receipt of the audio speaker grille, wherein the rubberized gasket is pressed against the outer facing sidewalls of the audio speaker grille to hold the main body thereon.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figure 1A:
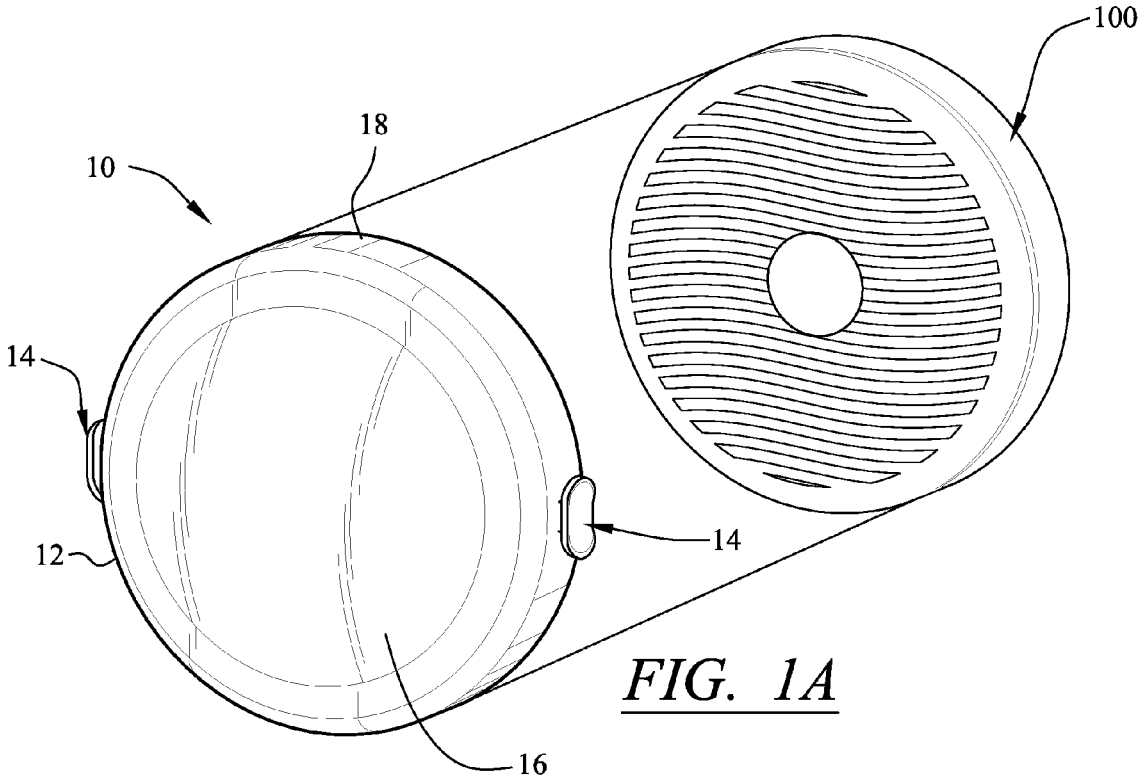
FIG. 1A is a perspective view of one embodiment of the protective speaker cover of the present invention, and illustrating alignment with the audio speaker grille for securing the protective speaker cover thereto.
Figure 1B:
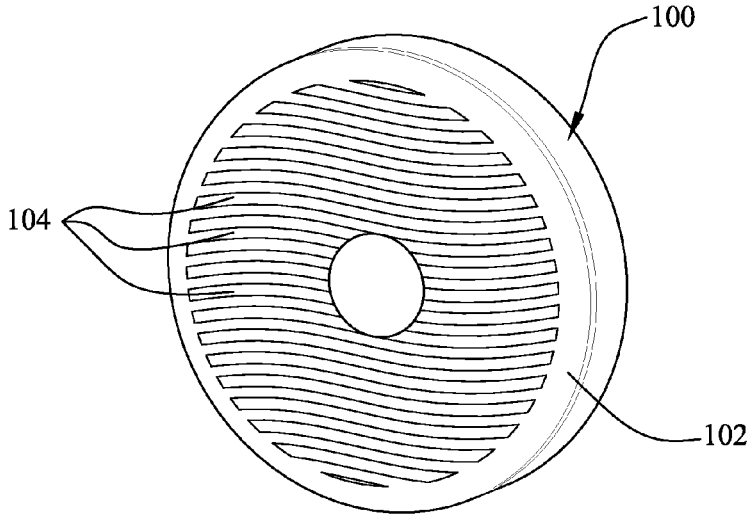
FIG. 1B is a perspective view of an audio speaker and overlaying audio speaker grille.

Referring to the several views of the drawings, the protective speaker cover of the present invention for use in conjunction with an audio speaker 100 is shown and is generally indicated as 10.

Referring to FIGS. 1A-5, the protective speaker cover 10 includes a main body 12 and a securing mechanism 14 for releasably securing the main body 12 to an audio speaker 100. The main body 12 includes a faceplate 16 having sidewalls 18 extending from an outer perimeter edge of the faceplate 16 and being sized to cover, i.e. encase, at least a portion of a speaker grille 102 (FIG. 1B) surrounding the audio speaker 100. In a preferred embodiment, the main body 12 is formed from a waterproof material for preventing exposure of corrosive elements, such as salt water, to the audio speaker 100 and audio speaker grille 102, and is sized and configured for use in conjunction with outdoor audio speakers.

Figure 2:
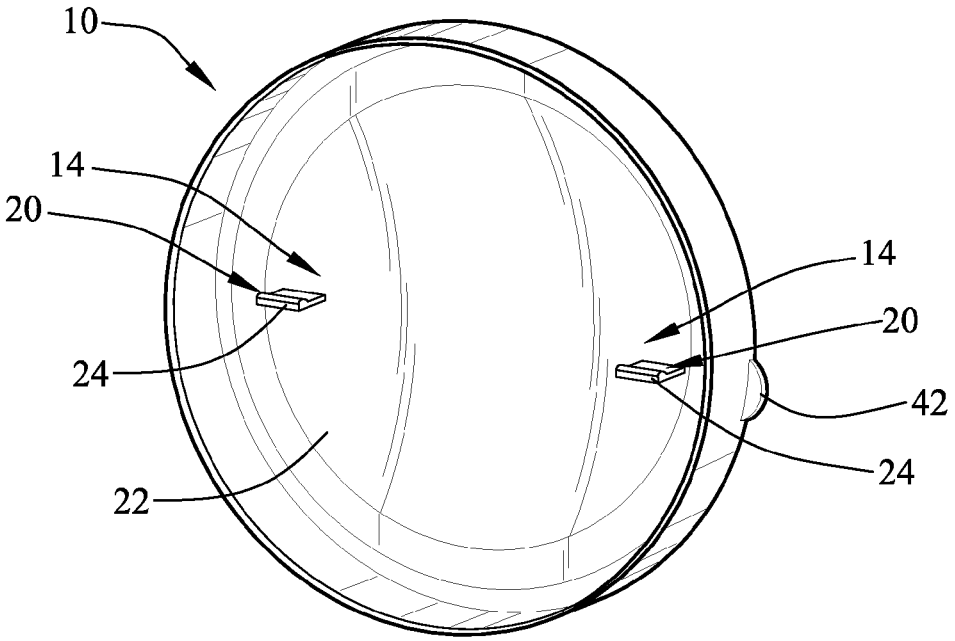
FIG. 2 is a perspective view of one embodiment of the protective speaker cover of the present invention.

Referring to FIG. 2, in one embodiment of the protective cover 10, the securing mechanism 14 is a plurality of aligned clips 20 each extending from the inner facing side 22 of the faceplate 16 and having protrusions 24 at a distal end and being sized for releasable, snap-locked engagement within the open grooves 104 of the audio speaker grille 102.

Figure 3:
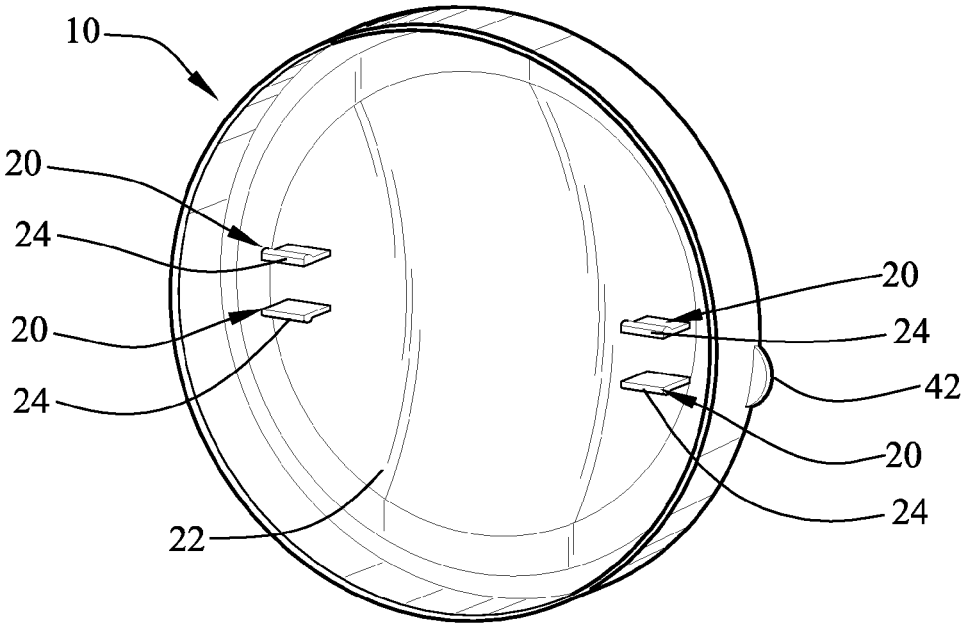
FIG. 3 is a perspective view of one embodiment of the protective speaker cover of the present invention.

Referring to FIG. 3, another embodiment of the securing mechanism 14 of the protective cover 10 is a plurality of aligned, oppositely disposed clips 20 each extending from the inner facing side 22 of the faceplate 16 and having protrusions 24 sized for releasable, snap-locked engagement within the open grooves 104 of the audio speaker grille 102.

Figure 4:
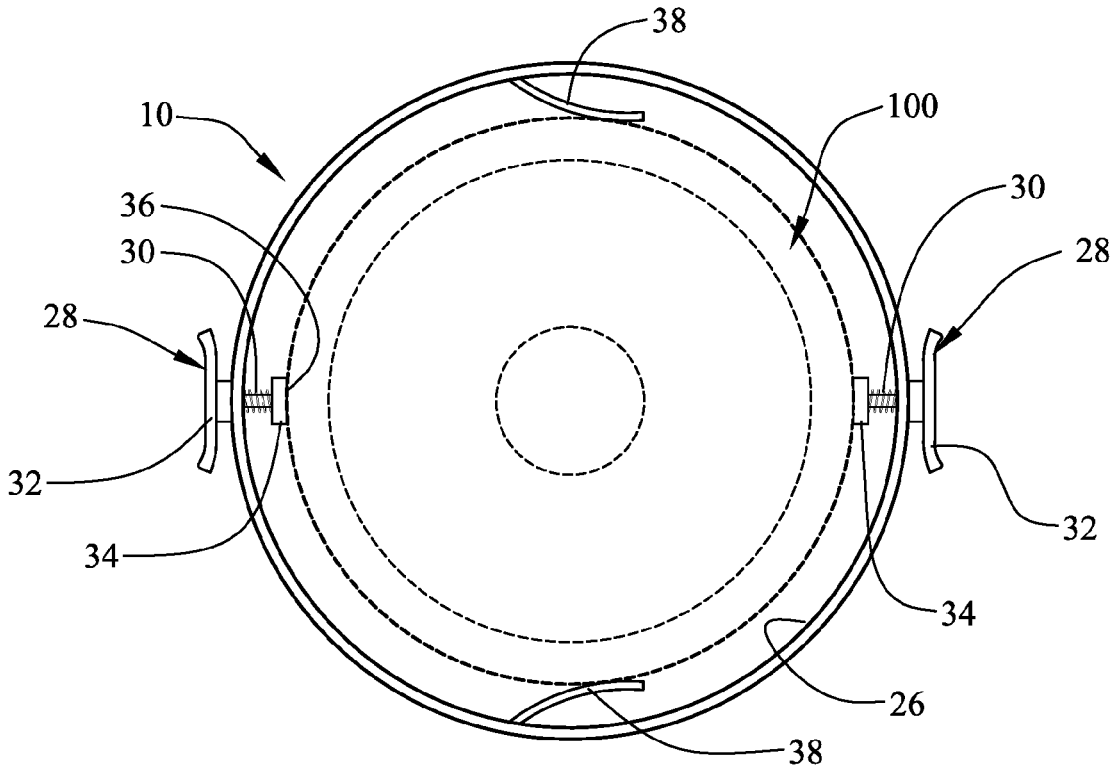
FIG. 4 is a top plan view of one embodiment of the protective speaker cover of the present invention.

Referring to FIG. 4, in another embodiment of the protective cover 10, the inner facing surface 26 of the sidewalls 18 includes at least one spring-loaded member 28 for securing the main body 12 against the outer facing wall of the audio speaker grille 102. Each spring-loaded member 28 includes a spring 30, a grasping member 32, and a foot member 34. To secure the main body 12 to the audio speaker grille 102 using the spring-loaded member(s) 28, the foot members 34 are retracted by applying tension force to the grasping member(s) 32, which are in connection with the foot member(s) 34. Retraction of the foot members 34 causes the spring(s) 30 to compress. The protective cover 10 is then placed over the audio speaker grille 102 and the grasping member(s) 32 are released, thereby causing the spring(s) 30 to expand and force the foot member(s) 34 against the outer facing wall of the audio speaker grille 102. The bottom surface 36 of the foot member 34 is formed from an elastic material suitable for not damaging the outer facing wall of the audio speaker grille 102 when the main body 12 is secured thereto. The inner facing surface 26 of the sidewalls 18 may further include biasing members 38 for providing additional force between the outer facing wall of the audio speaker grille 102 and the inner facing surface 26 of the sidewalls 18 of main body 12.

Figure 5:
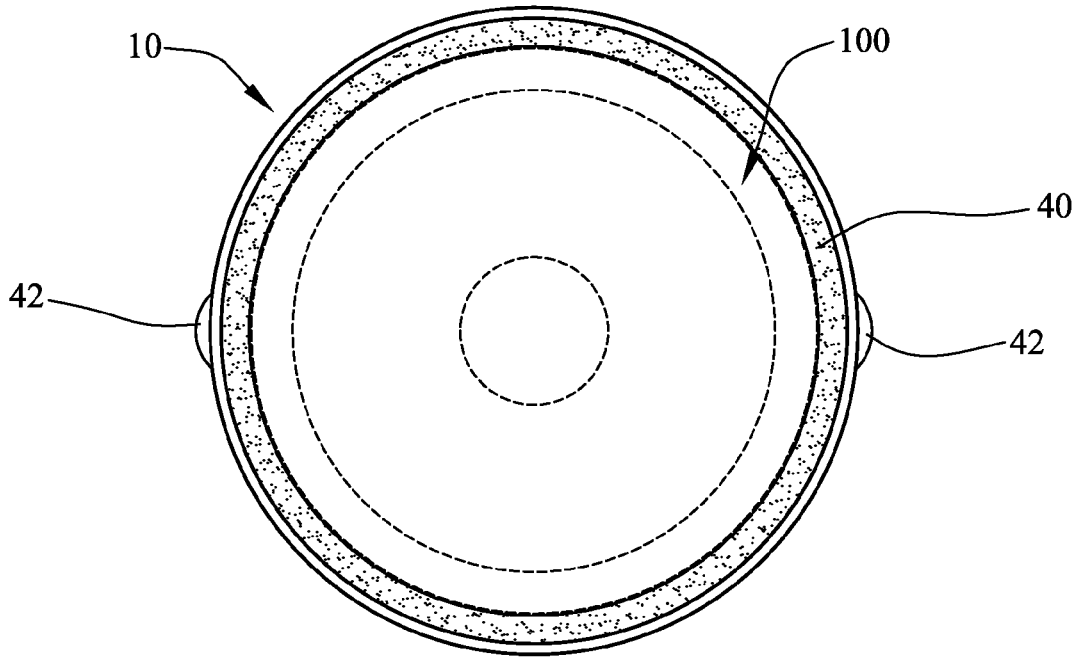
FIG. 5 is a top plan view of one embodiment of the protective speaker cover of the present invention.

Referring to FIG. 5, in another embodiment of the protective cover 10, the inner facing surface 26 of the sidewalls 18 includes an elastic lining 40 for frictionally engaged receipt of the audio speaker grille, wherein the elastic lining 40 is pressed against the outer facing sidewalls of the audio speaker grille 102 to hold the main body 12 thereon. At least one tab 42 extending from sidewalls 18 may be included for gripping when removing the protective cover 10 from an audio speaker grille 102.

Other securing mechanisms 14 not shown and described, such as a threaded, screw-on connection between the outer facing wall of the audio speaker grille 102 and the inner facing surface 26 of the sidewalls 18 of main body 12, may be used for securing the protective speaker cover 10 to an audio speaker grille 102.

While the present invention has been shown and described in accordance with a preferred and practical embodiment thereof, it is recognized that departures from the instant disclosure are fully contemplated within the spirit and scope of the present invention.

What is claimed is:

1. A protective cover for protecting an audio speaker and audio speaker grille, and said protective cover comprising:

a waterproof main body being sized and configured for encasing at least a portion of the audio speaker grille, and said main body including a faceplate having inner and outer facing sides and a sidewall extending from a perimeter edge zone of said faceplate, and said sidewall having an inner and outer facing surface;

a securing mechanism for releasably securing said main body to the audio speaker grille so that the audio speaker grille is protectively concealed behind said main body; and said main body being structured and disposed for limiting exposure of corrosive elements to the audio speaker and audio speaker grille.

2. The protective cover as recited in claim 1 wherein said securing mechanism is a plurality of aligned clips extending from the inner facing side of said faceplate, and said plurality of aligned clips being sized and configured for releasably securing said main body to the audio speaker grille by engaging at least one of a plurality of open slots on the audio speaker grille.

3. The protective cover as recited in claim 2 wherein each of said plurality of aligned clips includes a protrusion extending from a distal end of said clip.

4. The protective cover as recited in claim 1 wherein said securing mechanism is a plurality of aligned, oppositely disposed clips extending from the inner facing side of said faceplate, and said plurality of aligned, oppositely disposed clips being sized and configured for releasbly securing said main body to the audio speaker grille by engaging at least one of a plurality of open slots on the audio speaker grille.

5. The protective cover as recited in claim 4 wherein each of said plurality of aligned, oppositely disposed clips include a protrusion extending from a distal end of said clip.

6. The protective cover as recited in claim 1 further comprising at least one tab extending from the outer facing surface of said sidewall, and said at least one tab being sized and configured for gripping when removing said main body from the audio speaker grille.

7. A protective cover for protecting an audio speaker and audio speaker grille, and said protective cover comprising:

a waterproof main body being sized and configured for encasing at least a portion of the audio speaker grille, and said main body including a faceplate having inner and outer facing sides and a sidewall extending from a perimeter edge zone of said faceplate, and said sidewall having an inner and outer facing surface;

a securing mechanism for releasably securing said main body to the audio speaker grille so that the audio speaker grille is protectively concealed behind said main body, and said securing mechanism comprising:

at least one spring-loaded member comprising a spring, a grasping member and a foot member, and said spring-loaded member being structured and disposed for releasably securing said main body to the audio speaker grille by applying tension force to said grasping member to retract said foot member and compress said spring and releasing said grasping member to cause the force of said spring to urge a bottom surface of said foot member against an outer surface of the audio speaker grille; and said main body being structured and disposed for limiting exposure of corrosive elements to the audio speaker and audio speaker grille.

8. The waterproof cover as recited in claim 7 further comprising at least one biasing member on the inner facing surface of said sidewall of said main body, and said at least one biasing member being structured and disposed for applying force between the outer face of the audio speaker grille and the inner facing surface of said sidewall when the sidewall of said main body is fitted around the audio speaker grille.

9. The protective cover as recited in claim 7 further comprising at least one biasing member on the inner facing surface of said sidewall of said main body, and said at least one biasing member being structured and disposed for applying force between the outer face of the audio speaker grille and the inner facing surface of said sidewall when the sidewall of said main body is fitted around the audio speaker grille.

10. The waterproof cover as recited in claim 7 wherein the bottom surface of said foot member is rubberized.

11. The protective cover as recited in claim 7 further comprising at least one tab extending from the outer facing surface of said sidewall, and said at least one tab being sized and configured for gripping when removing said main body from the audio speaker grille.

12. A protective cover for protecting an audio speaker and audio speaker grille, and said protective cover comprising:

a waterproof main body being sized and configured for encasing at least a portion of the audio speaker grille, and said main body including a faceplate having inner and outer facing sides and a sidewall extending from a perimeter edge zone of said faceplate, and said sidewall having an inner and outer facing surface;

a securing mechanism for releasably securing said main body to the audio speaker grille so that the audio speaker grille is protectively concealed behind said main body, and said securing mechanism comprising:

a rubberized gasket on the inner facing surface of said sidewall, and said rubberized gasket being sized and configured for releasably securing said main body to the audio speaker grille by providing a friction-fit connection between the rubberized gasket and an outer surface of the audio speaker grille when the sidewall of said main body is fitted around the audio speaker grille; and said main body being structured and disposed for limiting exposure of corrosive elements to the audio speaker and audio speaker grille.

13. The protective cover as recited in claim 12 further comprising at least one tab extending from the outer facing surface of said sidewall, and said at least one tab being sized and configured for gripping when removing said main body from the audio speaker grille.

* * * * *